United States Patent [19]

Wunderlich

[11] 4,311,159

[45] Jan. 19, 1982

[54] PORTABLE TENT SHELTER

[76] Inventor: Frederick J. Wunderlich, 1599 Meisner Rd., Marine City, Mich. 48039

[21] Appl. No.: 126,821

[22] Filed: Mar. 3, 1980

[51] Int. Cl.[3] ..... A45F 1/00

[52] U.S. Cl. ..... 135/1 R; 135/4 R; 52/108

[58] Field of Search ..... 135/1 R, 4 R, 5 R; 52/108

[56] References Cited

U.S. PATENT DOCUMENTS

| | | | |
|---|---|---|---|
| 2,167,219 | 7/1939 | Sankey | 135/1 R |
| 2,475,515 | 7/1949 | Potter | 135/1 R |
| 3,082,780 | 3/1963 | Macy | 135/4 R |
| 3,190,300 | 6/1965 | Wear'n | 135/5 R |
| 3,353,547 | 11/1967 | Albright | 135/1 R |
| 3,925,943 | 12/1975 | Petrie | 135/4 R X |

FOREIGN PATENT DOCUMENTS

| | | | |
|---|---|---|---|
| 574681 | 4/1959 | Canada | 135/4 R |
| 1325748 | 3/1963 | France | 135/4 R |
| 444107 | 3/1936 | United Kingdom | 135/15 PE |

*Primary Examiner*—J. Karl Bell

*Attorney, Agent, or Firm*—Harvey B. Jacobson

[57] ABSTRACT

The shelter is supported by three flexible support members, two of which extend around opposite peripheral edges of the shelter and the third of which provides vertical support to the shelter center. Each of the flexible support members is formed from a plurality of segments which are connected on one side by a reinforcing tape and on the other side by elastic material in order that the supports can flex in one direction. The ends of the three flexible supports are attached to brackets disposed on opposite sides of the shelter and held to the ground by stakes or pins. By removing one of the brackets, the flexible supports are allowed to extend from the shelter material and the entire shelter can be rolled up into a compact form for storage or transportation.

10 Claims, 9 Drawing Figures

FIG. 1
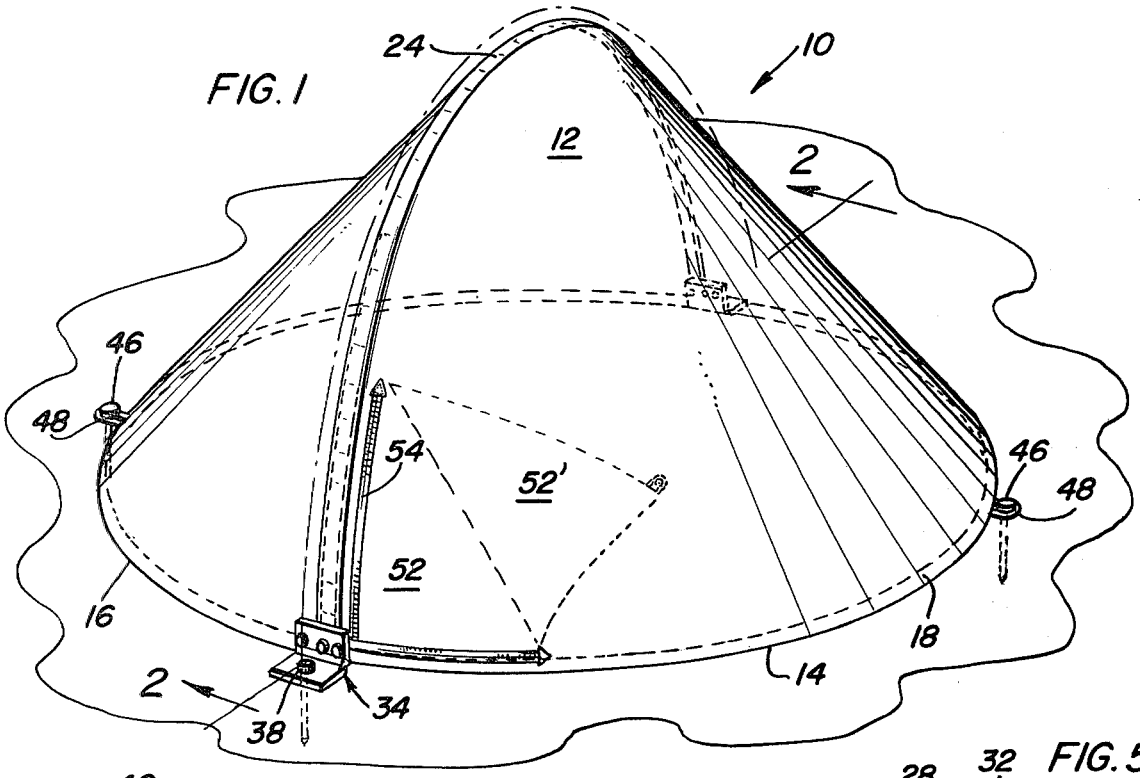
FIG. 4
FIG. 5
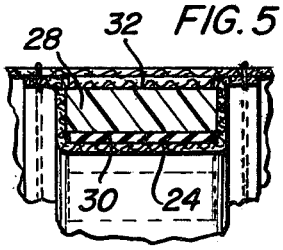
FIG. 2
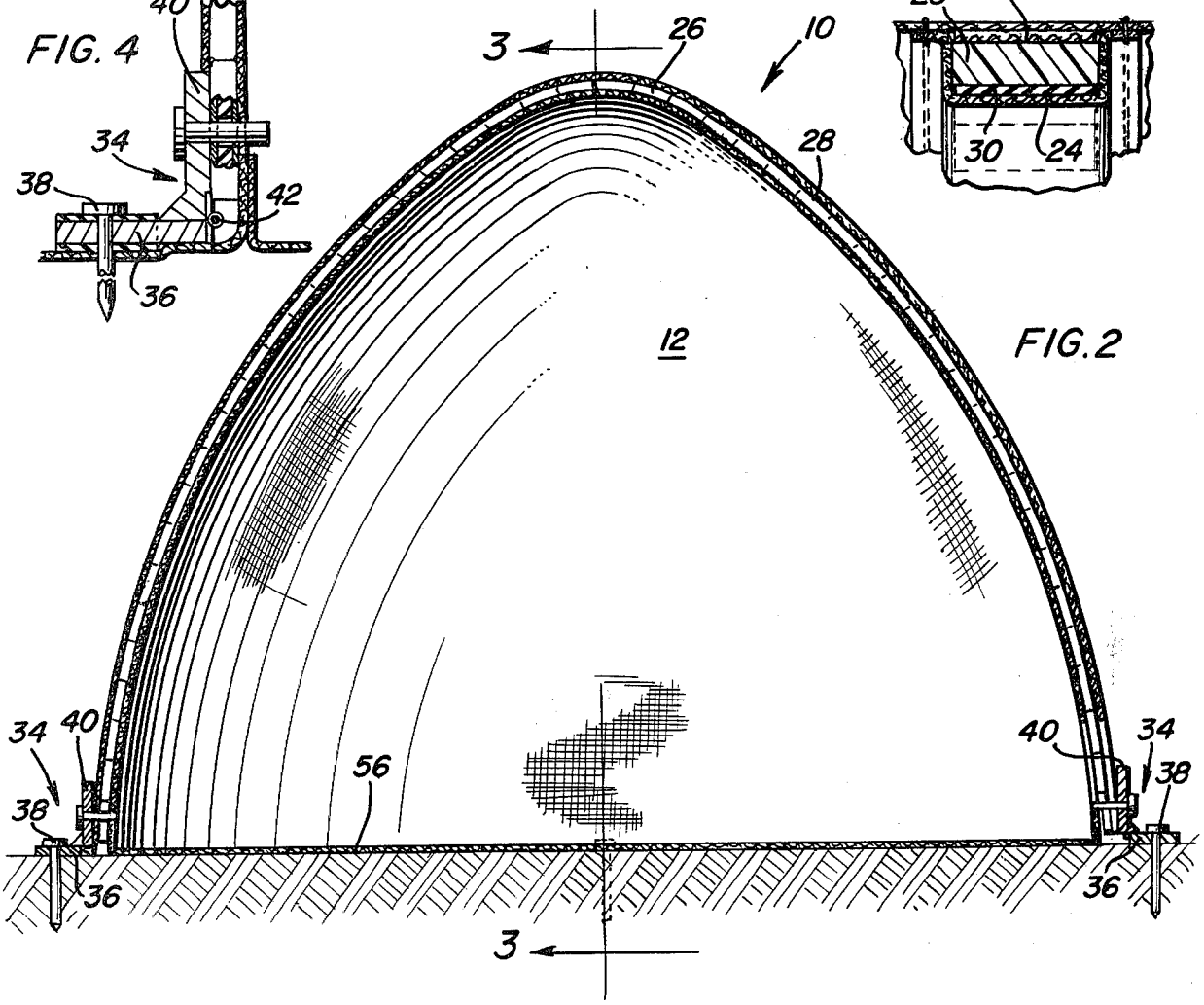

FIG. 3
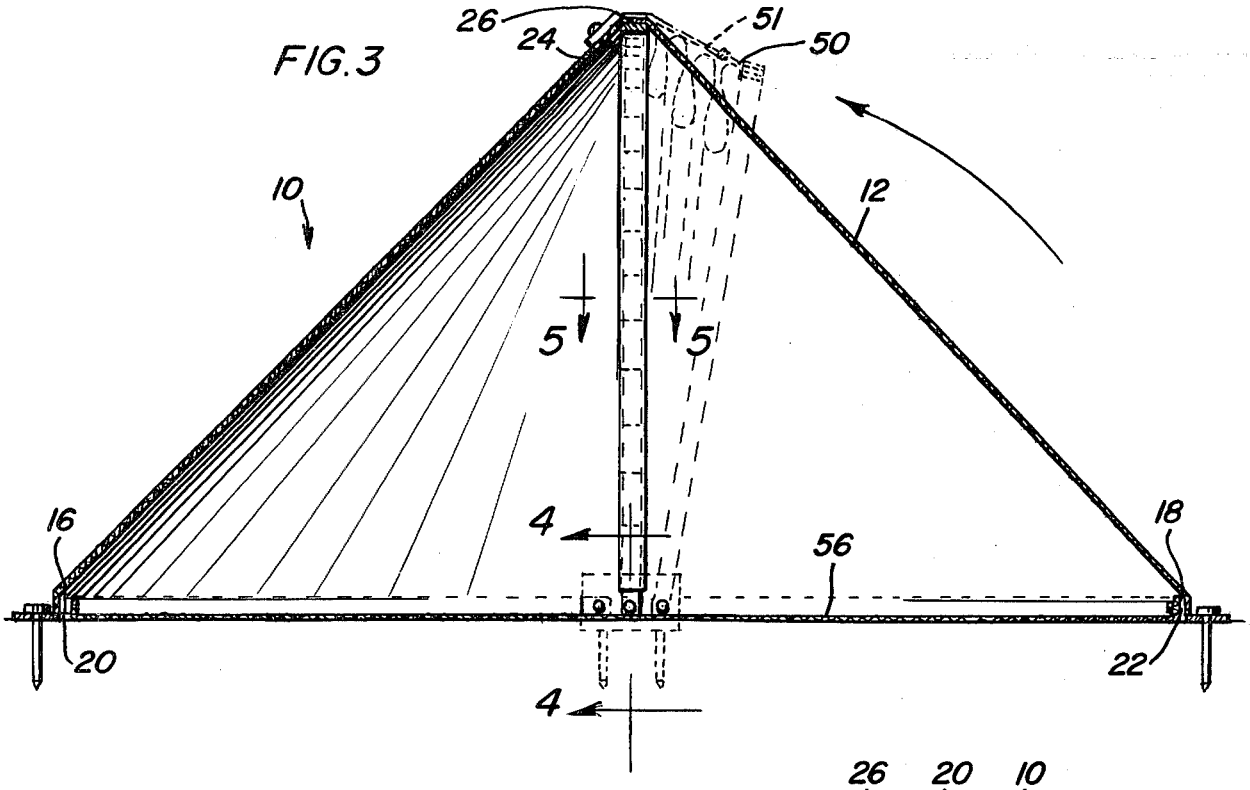
FIG. 7
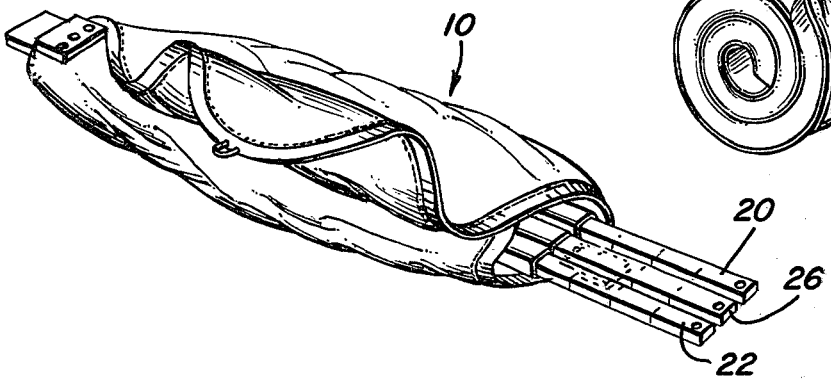
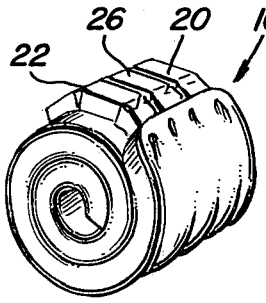
FIG. 6
FIG. 8
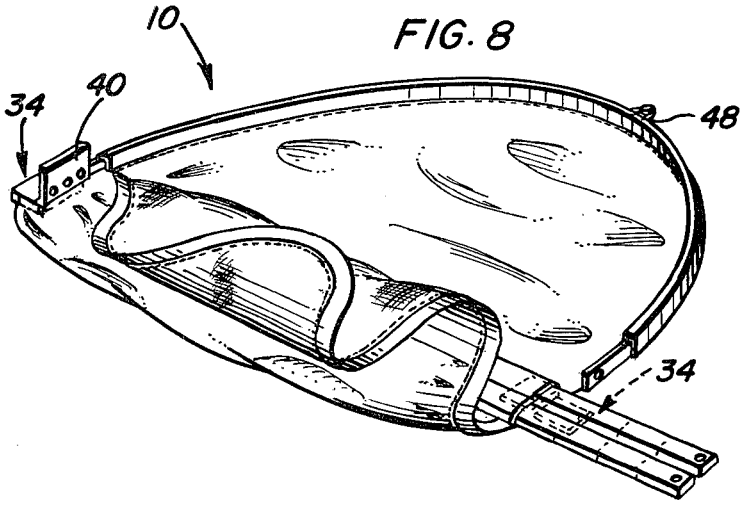
FIG. 9
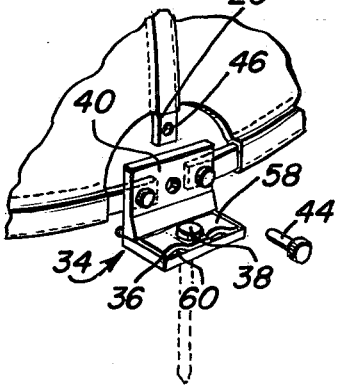

PORTABLE TENT SHELTER

BACKGROUND OF THE INVENTION

1. Field of the Invention

This invention relates to shelter structures and especially to such structures which can be easily erected, taken down and disposed in a compact form so as to be transported and stored easily.

2. Discussion of Related Art

Various shelters have been suggested which can be erected and collapsed with relative ease. For instance, U.S. Pat. No. 3,925,943, issued Dec. 16, 1975 to Petrie, shows a portable structure framing member capable of being coiled by bending the member in one direction and being uncoiled by bending it in the other direction to form a frame member which is relatively rigid. The member is constructed by forming an elongated one-piece body of suitably flexible material, such as polypropylene, by extrusion. Strong, flexible threads are imbedded in one side of the body and a passageway is formed extending lengthwise through the body. During the extrusion period, the body member is cut or notched transversely at locations distributed along the length of the body member.

U.S. Pat. No. 3,353,547, issued Nov. 21, 1967 to Albright, shows a tent structure supported by supporting members comprised of sections hinged together so as to limit relative movement in one direction when the supporting member is in a rigid supporting position, and at the same time turnable in a second direction so that the supporting members may be rolled in such direction. The hinge means between the sections extend in a somewhat biased rather than normal direction from the direction the supporting member extends, so that the supporting member rolls into a helix rather than a coplanar spiral.

SUMMARY OF THE INVENTION

One object of the present invention is to provide a tent shelter which can be erected with little effort and is easily disassembled and repacked.

A further object of the present invention is to provide a shelter which is self-supporting with flexible supports being sewn into the tent material.

An even still further object of the present invention is to provide a tent shelter wherein one portion of the shelter can be pivoted upward to provide additional air or sunshine.

An even still further object of the present invention is to provide a tent shelter wherein a screen can be attached over a portion which is pivoted upward.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the tent shelter of the present invention.

FIG. 2 is a elevational sectional view taken substantially along a plane passing through section line 2—2 of FIG. 1.

FIG. 3 is an elevational sectional view taken substantially along a plane passing through section line 3—3 of FIG. 2.

FIG. 4 is a elevational sectional view taken substantially along a plane passing through section line 4—4 of FIG. 3.

FIG. 5 is a top plan sectional view taken substantially along a plane passing through section line 5—5 of FIG. 3.

FIG. 6 is a perspective view showing the tent shelter rolled up.

FIG. 7 is a perspective view showing the tent shelter unrolled prior to erection.

FIG. 8 is a perspective view showing the tent shelter in the process of being erected.

FIG. 9 is a perspective view showing the connection of the flexible supports to the bracket.

DESCRIPTION OF THE PREFERRED EMBODIMENT

Now with reference to the drawings, a tent shelter incorporating the principles and concepts of the present invention and generally referred to by the reference numeral 10 will be described in detail. With particular reference to FIGS. 1–3, it can be seen that the shelter includes a fabric covering 12 which comprises preferably nylon but could be canvas or any other standard tent material. Covering 12 has a circular peripheral edge 14 which has two channels 16 and 18 formed therein for the reception of flexible support members 20 and 22, respectively. A third channel 24 extends across the middle of fabric 12 and receives a third flexible support member 26. With reference to FIGS. 2 and 5, the structure of flexible support 26 will be set forth with it being understood that the structure of supports 20 and 22 is similar to that of support 26. It can be seen that support 26 comprises a plurality of individual blocks 28 which can be formed from metal, wood, plastic or any other suitable material. Blocks 28 are generally rectangular in shape and are interconnected on their lower surfaces by reinforced tape 30 which can be any strong, flexible material that will adhere to each of the blocks so as to allow the blocks to flex. The opposite surfaces of the blocks 28 are interconnected by an elastic material 32. Elastic 32 extends across each block and is secured thereto in a manner which allows the blocks to bend around tape 30 thus stretching elastic 32 to form an arcuate shape as depicted in FIG. 2. When the flexible support 26 is allowed to relax, elastic 32 draws the blocks together into linear alignment.

The ends of supports 20, 22 and 26 extend out from their respective channels and converge at diametrically opposite points on the peripheral edge 14. The converging ends of the support members engage hinged brackets 34 which are shown clearly in FIGS. 1, 2, 4 and 9. Each bracket 34 has a lower planar member 36 which is designed to lie flat on the ground upon which the shelter 10 is erected. A pin or stake 38 extends through an aperture in member 36 to hold the bracket 34 against lateral movement upon the ground support surface. Vertical member 40 is also planar and is hingedly attached to member 36 by hinge joint 42. Member 40 has three apertures formed therein for receiving pins 44 which pass through one of the apertures and into apertures formed in the ends of the flexible supports as, for example, into aperture 46 of flexible support 26 shown in FIG. 9. Clearly, with opposite ends of the supports attached to the brackets 34, and with pins 38 holding the brackets 34 in place, the arcuate shape of the flexible supports is maintained and thus the shape of the tent shelter is insured. Additional pins or stakes 46 can be inserted through stake loops 48 which are attached medially of channels 16 and 18 to hold down the halves of the tent structure. If one of the pins 46 is removed, the tent structure half held by that pin can be pivoted upwardly as shown in phantom in FIG. 3 at 50. A tie strap 51 is attached to the top of the tent structure for connection to the stake loop 48 in order to hold the tent half up, thereby allowing the interior of the tent to be readily accessible for increased air circulation or easier personal access. If desired, a mosquito net or screen can be attached to the peripheral edge of the folded up tent half, and used to enclose the interior of the tent structure to maintain it free from insects.

In order to gain access to the interior of the tent, one-half of the tent can be folded up as shown in FIG. 3 or, the entry flap shown at 52 can be opened and folded back as shown at 52' in FIG. 1. Flap 52 is secured to the tent body by a zipper 54.

Further, the tent can contain a floor shown at 56 in FIG. 2. Floor 56 can be sewn in the tent body as an integral part thereof, if desired. However, the tent functions in the described manner with or without floor 56.

With reference to FIGS. 6–8, the procedure for tent erection will now be set forth. With reference to FIG. 6, it can be seen that the shelter 10 is initially rolled up in a compact configuration with the flexible supports 20, 22 and 26 extending from their respective channel openings. For convenience, it is preferable that the opposite end of each flexible support 20, 22 and 26 be sewn into its respective channel in order that the supports will not inadvertently fall out and be lost. The tent is unrolled as shown in FIG. 7 with the supports 20, 22 and 26 extending linearly therefrom. The brackets 34 are staked to the ground and the sides of the tent are pulled outwardly. The bracket upper portions 40 are tilted up and the flexible supports are individually pinned to the brackets. The center support is then raised and the structure halves are held to the ground by placing pins through loops 48.

In breaking the shelter down, the pins through loops 48 are removed. The pins in flexible support 26 are removed thus allowing the shelter to collapse. The other two flexible supports are then removed from the bracket 34 and allowed to extend from their respective channels. The pins 38 holding the brackets to the ground are removed and the shelter can then be folded and rolled into its compact form.

It is also noted that for ease of erection and breaking down of the shelter, it may be desirable to permanently pin one bracket 40 to the ends of the flexible supports which remain stationary with respect to their associated channels. The brackets may be attached to the shelter body and provided with elastic bands 58 with pockets 60 to receive the pins 46 and hold them firmly in place when not in use.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A tent shelter capable of being quickly and easily erected and collapsed, said shelter comprising:

a fabric body for erection as a tent shelter having a ground contacting edge;

at least one flexible support member operably attached to said ground contacting edge of said fabric body so as to facilitate an erection of said tent shelter; and at least one further flexible support member operably attached to said fabric body and serving to support said tent shelter in an erected manner above a ground surface, said at least one flexible support member and said at least one further flexible support member each being formed in part from a plurality of separate blocks operably attached to one another by a flexible support means, said flexible support means being a continuous substantially inelastic strap member fixedly secured to said plurality of separate blocks, said plurality of separate blocks being additionally attached to one another by a flexible elastic support means.

2. The tent shelter as defined in claim 1, wherein said flexible support means comprises a continuous elastic strap member fixedly secured to each of said plurality of said separate blocks.

3. The tent shelter as defined in claim 2, and further wherein said plurality of said separate blocks are aligned in an end-to-end relationship with said continuous inelastic strap member being fixedly secured to first planar surfaces associated with said plurality of said separate blocks and said continuous elastic strap member being fixedly secured to second planar surfaces of said plurality of said separate blocks.

4. The tent shelter as defined in claim 3, wherein said at least one flexible support member and said at least one further flexible support member are respectively formable into arcuate shapes by an elastic expansion of a respective associated continuous elastic strap member operably attached thereto.

5. The tent shelter as defined in claim 1, and further wherein said plurality of said separate blocks are aligned in an end-to-end relationship with said continuous inelastic strap member being fixedly secured to first planar surfaces associated with said plurality of said separate blocks and a continuous elastic strap member being fixedly secured to second planar surfaces of said plurality of said separate blocks.

6. The tent shelter as defined in claim 1, wherein said at least one flexible support member and said at least one further flexible support member are respectively formable into arcuate shapes by an elastic expansion of a respective associated continuous elastic strap member operably attached thereto.

7. The tent shelter as defined in claim 1, and further wherein said at least one flexible support member and said at least one further flexible support member are interconnected through a bracket means operably attachable to said ground surface, said bracket means being of a hinged construction to facilitate a positioning thereof and an interconnecting of said at least one flexible support member and said at least one further flexible support member thereto.

8. The tent shelter as defined in claim 7, wherein said bracket means includes flexible pocket means attached thereto, said flexible pocket means being utilizable to store ground and support member connection pins therein.

9. A tent shelter comprising a fabric body having a peripheral edge, said peripheral edge approximating a circle, a first flexible support member connected to at least a portion of said peripheral edge, a second flexible support member being connected to a second portion of said peripheral edge, and a third flexible support member being connected to said body at a position spaced from said peripheral edge, said first, second and third flexible support members having ends which converge at opposite sides of said body, each of said flexible support members being disposed in a channel formed in said body and each including a plurality of generally rectangular separate blocks, each of said separate blocks having one surface interconnected by a flexible generally inelastic material and an opposite surface interconnected by a flexible generally elastic material.

10. The tent shelter as defined in claim 9, wherein said flexible support members are a continuous substantially inelastic strap member fixedly secured to said plurality of separate blocks.

* * * * *